US009352565B2

(12) United States Patent
Domae et al.

(10) Patent No.: US 9,352,565 B2
(45) Date of Patent: May 31, 2016

(54) LIQUID JET HEAD AND LIQUID JET APPARATUS

(71) Applicant: SII PRINTEK INC., Chiba (JP)

(72) Inventors: Yoshinori Domae, Chiba (JP); Yuzuru Kubota, Chiba (JP); Satoshi Horiguchi, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/065,872

(22) Filed: Oct. 29, 2013

(65) Prior Publication Data

US 2014/0125740 A1 May 8, 2014

(30) Foreign Application Priority Data

Nov. 5, 2012 (JP) ..... 2012-243845

(51) Int. Cl.

| | |
|---|---|
| ***B41J 2/045*** | (2006.01) |
| ***B41J 2/18*** | (2006.01) |
| ***B41J 2/14*** | (2006.01) |
| ***B41J 2/16*** | (2006.01) |

(52) U.S. Cl.

CPC ..... *B41J 2/14209* (2013.01); *B41J 2/1609* (2013.01); *B41J 2/18* (2013.01); *B41J 2202/12* (2013.01)

(58) Field of Classification Search

CPC ..... B41J 2/1433; B41J 2/1429; B41J 2002/14411

See application file for complete search history.

(56) References Cited

U.S. PATENT DOCUMENTS

| | | | | |
|---|---|---|---|---|
| 2002/0146329 | A1* | 10/2002 | Takeuchi et al. | 417/322 |
| 2009/0185012 | A1* | 7/2009 | Koseki | 347/71 |
| 2011/0109703 | A1* | 5/2011 | Koseki | 347/71 |
| 2013/0187986 | A1* | 7/2013 | Koseki | 347/47 |

FOREIGN PATENT DOCUMENTS

| | | |
|---|---|---|
| EP | 2700506 | 2/2014 |
| JP | 2011104791 | 6/2011 |
| WO | 2012144597 | 10/2012 |

OTHER PUBLICATIONS

Watanabe, Ink-Jet Head, Oct. 26, 2012, WO 2012144597.*

* cited by examiner

*Primary Examiner* — Shelby Fidler
*Assistant Examiner* — Tracey McMillion
(74) *Attorney, Agent, or Firm* — Adams & Wilks

(57) ABSTRACT

A liquid jet head includes an actuator substrate having an alternating array of ejection grooves and non-ejection grooves which penetrate from an upper surface to a lower surface of the actuator substrate and are longer in a substrate surface direction than in a depth direction. A cover plate attached to the actuator substrate covers upper surface openings of the grooves, and a nozzle plate attached to the actuator substrate covers lower surface openings of the grooves. The grooves are formed in such a manner that configurations of the lower surface openings of the ejection grooves and the non-ejection grooves are different.

13 Claims, 5 Drawing Sheets

LIQUID JET HEAD AND LIQUID JET APPARATUS

BACKGROUND

1. Technical Field

The present invention relates to a liquid jet head for ejecting and recording droplets on a recording medium, and a liquid jet apparatus using this liquid jet head.

2. Related Art

In recent years, there has been utilized an ink jet type liquid jet head for ejecting ink droplets on a recording paper or the like and recording characters or graphics, or an ink jet type liquid jet head for ejecting a liquid material on a surface of an element substrate and forming a functional thin film. In this system, liquid such as ink or a liquid material is guided to a channel from a liquid tank via a supply tube, a pressure is applied to the liquid filling the channel, and the liquid is ejected from a nozzle communicated with the channel. When the liquid is ejected, the liquid jet head or the recording medium is moved and characters or graphics are recorded, or a functional thin film having a predetermined configuration is formed.

FIGS. 8A and 8B are schematic cross-sectional views of a liquid jet head 101 described in JP 2011-104791 A. FIG. 8A is a schematic longitudinal cross-sectional view of a groove 105 for generating a pressure wave in liquid, and FIG. 8B is a schematic cross-sectional view of the groove 105 in a direction orthogonal thereto. The liquid jet head 101 has a laminate structure including a piezoelectric plate 104 formed of a piezoelectric body, a cover plate 108 adhered to one surface of the piezoelectric plate 104, a flow path member 111 adhered onto the cover plate 108, and a nozzle plate 102 adhered to another surface of the piezoelectric plate 104. A deep groove 105a and a shallow groove 105b, which form the groove 105, are alternately formed in parallel on the piezoelectric plate 104. The deep groove 105a penetrates from the one surface to the other surface of the piezoelectric plate 104. The shallow groove 105b opens on the one surface of the piezoelectric plate 104, and a piezoelectric material is left on the other surface thereof. Side walls 106a to 106c are formed between the deep groove 105a and the shallow groove 105b. Drive electrodes 116a or 116c are formed on side surfaces of the deep groove 105a, and drive electrodes 116b or 116d are formed on side surfaces of the shallow groove 105b.

The cover plate 108 is provided with a liquid supply port 109 and a liquid discharge port 110. The liquid supply port 109 communicates with one end portion of the deep groove 105*a*, and the liquid discharge port 110 communicates with another end portion thereof. The flow path member 111 is provided with a liquid supply chamber 112 and a liquid discharge chamber 113. The liquid supply chamber 112 communicates with the liquid supply port 109, and the liquid discharge chamber 113 communicates with the liquid discharge port 110. The nozzle plate 102 is provided with a nozzle 103, and the nozzle 103 communicates with the deep groove 105*a*.

This liquid jet head 101 is driven as follows. Liquid supplied through a supply joint 114 provided at the flow path member 111 fills the deep groove 105*a* via the liquid supply chamber 112 and the liquid supply port 109. Further, the liquid filling the deep groove 105*a* is discharged from a discharge joint 115 via the liquid discharge port 110 and the liquid discharge chamber 113 to the outside. Then, a potential difference is generated between the drive electrodes 116*c* and 116*b* and between the drive electrodes 116*c* and 116*d*. Accordingly, the side walls 106*b* and 106*c* are deformed in a thickness-shear mode, generating a pressure wave in the deep groove 105*a*. As a result, droplets are ejected from the nozzle 103.

In the liquid jet head 101 described in JP 2011-104791 A, the deep groove 105*a* for ejecting droplets and the shallow groove 105*b* for not ejecting droplets are alternately formed. The shallow groove 105*b* does not open on the nozzle plate 102 side of the piezoelectric plate 104, and the deep groove 105*a* opens on the nozzle plate 102 side thereof. The deep groove 105*a* and the shallow groove 105*b* are formed using a dicing blade (also referred to as "diamond cutter") in which abrasive grains of, for example, diamond are embedded in an outer peripheral portion of a disk. As a result, as illustrated in FIG. 8A, an outer configuration of the dicing blade is transferred to both end portions of the groove 105. Normally, the dicing blade having a diameter of 2 inches or more is used. For example, when a depth of the deep groove 105*a* is 360 μm, a depth of the shallow groove 105*b* is 320 μm, and the piezoelectric plate 104 of 40 μm is left at a bottom portion of the shallow groove 105*b, a* circular configuration having a total of about 8 mm is formed at the both end portions of the shallow groove 105*b* in a longitudinal direction thereof. The circular configuration at the end portions of the shallow groove 105*b* is an unnecessary area. If this length can be shortened, the liquid jet head 101 can be made small and the number of the liquid jet heads 101 that can be taken from a piezoelectric wafer can be increased.

Therefore, if the piezoelectric plate 104 is not left on the bottom surface of the shallow groove 105*b* and the shallow groove 105*b* penetrates the piezoelectric plate 104 as with the deep groove 105*a*, the groove 105 having a short longitudinal length can be formed. As a result, the liquid jet head 101 is miniaturized and the number of the liquid jet heads 101 that can be taken from the piezoelectric wafer increases.

FIG. 9 is a schematic plan view of the piezoelectric plate 104 before the nozzle plate 102 is adhered thereto, as viewed from a side opposite to the cover plate 108 (see FIGS. 8A and 8B). In manufacturing process steps of the liquid jet head 101, the grooves 105 are formed in the piezoelectric plate 104, and then the cover plate 108 and the flow path member 111 are adhered to the piezoelectric plate 104 on the side where the grooves 105 have been formed. Next, the grooves 105 are caused to penetrate by grinding a surface of the piezoelectric plate 104 on a side opposite to the cover plate 108, and then the nozzle plate 102 is adhered to the surface of the piezoelectric plate 104 on the side opposite to the cover plate 108. Accordingly, the nozzle plate 102, in which the nozzle 103 has been previously formed, is adhered to a surface illustrated in FIG. 9. Alternatively, the nozzle 103 is opened by being irradiated with a laser beam after the nozzle plate 102 has been adhered to the surface. However, since 100 or more grooves 105 having the same configuration and having narrow pitches of 80 μm to 200 μm in an array direction are formed, it is difficult to distinguish the ejection groove 105 (the deep groove 105*a* in FIGS. 8A and 8B) from the non-ejection groove 105 (the shallow groove 105*b* in FIGS. 8A and 8B).

SUMMARY OF THE INVENTION

The present invention has been made in consideration of the above-described problems, and an object thereof is to provide a liquid jet head in which an ejection groove and a non-ejection groove are easily distinguished through a nozzle plate.

A liquid jet head according to an embodiment of the present invention includes: an actuator substrate formed by arraying a plurality of grooves, which penetrates from an upper surface to a lower surface of the substrate and is long in a surface direction; and a nozzle plate provided at the actuator substrate to cover a lower surface opening of the groove, wherein the groove includes an ejection groove and a non-ejection groove which are alternately arrayed, and the ejection groove and the non-ejection groove are different in configurations of the lower surface openings or in positions of the lower surface openings in a longitudinal direction.

Further, a longitudinal length of the lower surface opening of the non-ejection groove is different from a longitudinal length of the lower surface opening of the ejection groove.

Further, the longitudinal length of the lower surface opening of the non-ejection groove is longer than the longitudinal length of the lower surface opening of the ejection groove.

Further, the lower surface opening of the non-ejection groove is longer than the lower surface opening of the ejection groove on any one side in the longitudinal direction.

Further, the longitudinal length of the lower surface opening of the non-ejection groove is shorter than the longitudinal length of the lower surface opening of the ejection groove.

Further, any one side of the lower surface opening of the non-ejection groove is shorter than any one side of the lower surface opening of the ejection groove in the longitudinal direction.

Further, in a direction in which the grooves are arrayed, the longitudinal length of the lower surface opening of the groove placed at least at one edge is different from the longitudinal lengths of the lower surface openings of the grooves at other positions.

Further, a width of the lower surface opening of the non-ejection groove is different from a width of the lower surface opening of the ejection groove in a short side direction.

Further, the width of the lower surface opening of the non-ejection groove is larger than the width of the lower surface opening of the ejection groove in the short side direction.

Further, the width of the lower surface opening of the non-ejection groove is smaller than the width of the lower surface opening of the ejection groove in the short side direction.

Further, the non-ejection groove is placed at the edge in the direction in which the grooves are arrayed.

Further, the liquid jet head includes a cover plate provided at the actuator substrate to partially cover an upper surface opening of the groove.

Further, the nozzle plate includes a light transmitting film.

A liquid jet apparatus of the present invention includes: the liquid jet head according to any one of the aspects described above; a moving mechanism configured to relatively move the liquid jet head and a recording medium; a liquid supply tube configured to supply liquid to the liquid jet head; and a liquid tank configured to supply the liquid to the liquid supply tube.

The liquid jet head of the present invention includes: the actuator substrate formed by arraying the plurality of grooves, which penetrates from the upper surface to the lower surface of the substrate and is long in the surface direction; and the nozzle plate provided at the actuator substrate so as to cover the lower surface opening of the groove, wherein the groove includes the ejection groove and the non-ejection groove which are alternately arrayed, and the ejection groove and the non-ejection groove are different in the configurations of the lower surface openings or the positions formed of the lower surface openings in the longitudinal direction. With this configuration, since the ejection groove and the non-ejection groove can be easily distinguished, it becomes easy to align the nozzle with the ejection groove.

DETAILED DESCRIPTION (First Embodiment)

Figure 1A:
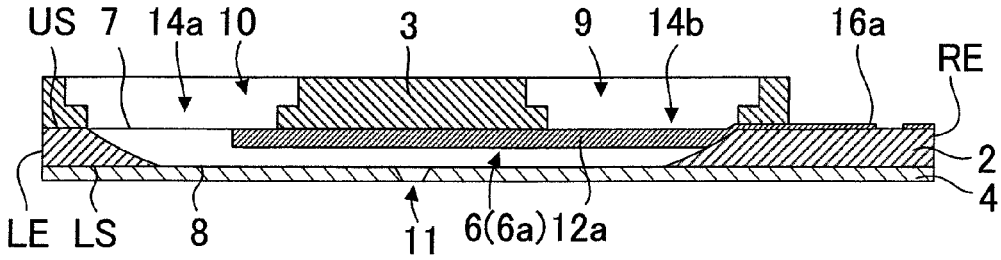
FIGS. 1A to 1C are explanatory diagrams of a liquid jet head according to a first embodiment of the present invention.
Figure 1B:
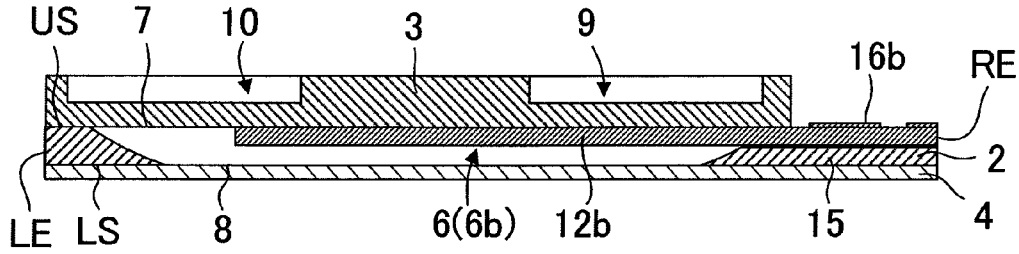
Figure 1C:
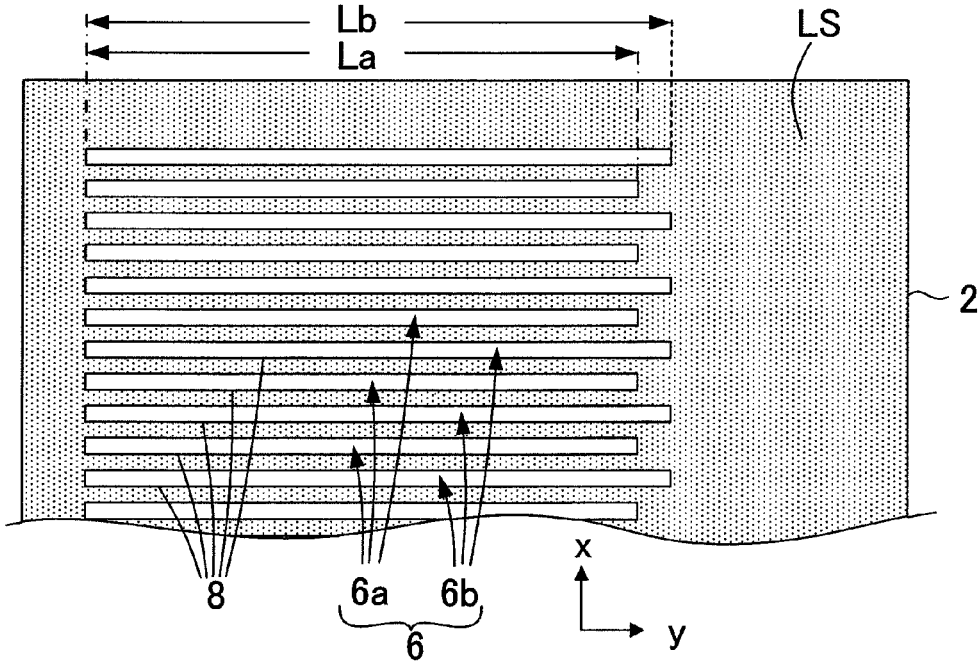

FIGS. 1A to 1C are explanatory diagrams of a liquid jet head 1 according to a first embodiment of the present invention. FIG. 1A is a schematic cross-sectional view of an ejection groove 6*a* in a longitudinal direction thereof, FIG. 1B is a schematic cross-sectional view of a non-ejection groove 6*b* in a longitudinal direction thereof, and FIG. 1C is a schematic plan view of an actuator substrate 2 as viewed from a droplet ejection side.

The liquid jet head 1 according to the first embodiment of the present invention has a structure obtained by laminating a nozzle plate 4, the actuator substrate 2, and a cover plate 3. A plurality of grooves 6, which penetrates from an upper surface US to a lower surface LS of the actuator substrate 2 and is long in a surface direction of the upper surface US or the lower surface LS, is arrayed in the actuator substrate 2. The cover plate 3 is provided at the actuator substrate 2 so as to cover an upper surface opening 7 of the groove 6. The nozzle plate 4 is provided at the actuator substrate 2 so as to cover a lower surface opening 8 of the groove 6. The groove 6 includes an ejection groove 6*a* and a non-ejection groove 6*b* which are alternately arrayed. The ejection groove 6*a* and the non-ejection groove 6*b* are formed in such a manner that configurations of the lower surface openings 8 are different from each other.

With this configuration, when the nozzle plate 4 is adhered to the lower surface LS of the actuator substrate 2, by using a light transmitting film as the nozzle plate 4, a nozzle (nozzle opening) 11 formed in the nozzle plate 4 can be easily aligned with the ejection groove 6a of the actuator substrate 2. Alternatively, after the nozzle plate 4 is adhered to the lower surface LS of the actuator substrate 2, it is easier to determine the position of the nozzle 11 communicating with the ejection groove 6*a* and to cause the nozzle 11 to open.

A concrete description will be given below. As illustrated in FIG. 10, a longitudinal length Lb of the lower surface opening 8 of the non-ejection groove 6*b* is longer than a longitudinal length La of the lower surface opening 8 of the ejection groove 6*a*. More specifically, in an array direction (x direction) of the grooves 6, end portions on one side (−y direction side) of the lower surface openings 8 of the ejection groove 6*a* and the non-ejection groove 6*b* align, and an end portion on another side (+y direction side) of the lower surface opening 8 of the non-ejection groove 6*b* is longer than that of the lower surface opening 8 of the ejection groove 6*a* toward the other side (+y direction side). With this configuration, the ejection groove 6*a* and the non-ejection groove 6*b* can be easily distinguished, as viewed from the lower surface LS side of the actuator substrate 2.

The ejection groove 6*a* and the non-ejection groove 6*b* of the actuator substrate 2 can be formed by grinding with a disk-shaped dicing blade. During this grinding, by grinding the non-ejection groove 6*b* deeper than the ejection groove 6*a*, or by grinding the non-ejection groove 6*b* longer than the ejection groove 6*a* in the longitudinal direction, a pattern of the lower surface openings 8 illustrated in FIG. 10 can be easily formed. The ejection groove 6*a* is formed in an area from the vicinity of the end portion on one side of the actuator substrate 2 to the vicinity of the end portion on the other side thereof and the vicinity of an end portion of the cover plate 3. The non-ejection groove 6*b* is formed in an area from the vicinity of the end portion on the one side of the actuator substrate 2 to the end portion on the other side thereof. A raised bottom portion 15 is formed at this end portion on the other side. The strength of the actuator substrate 2 can be improved by this raised bottom portion 15.

Common electrodes 12*a* having a depth not reaching a bottom surface of the ejection groove 6*a*, i.e., the nozzle plate 4, are formed on both side surfaces of the ejection groove 6*a* and electrically connected to a common terminal 16*a* formed on the upper surface US at the end portion on the other side. Likewise, active electrodes 12*b* having a depth not reaching a bottom surface of the non-ejection groove 6*b*, i.e., the nozzle plate 4, are formed on both side surfaces of the non-ejection groove 6*b* and electrically connected to an active terminal 16*b* formed on the upper surface US at the end portion on the other side. The active electrodes 12*b* formed on the both side surfaces of the non-ejection groove 6*b* are electrically separated from each other. It should be noted that the common terminal 16*a* and the active terminal 16*b* serve as lands connected to terminals of a flexible substrate (not illustrated).

The cover plate 3 is provided with a liquid discharge chamber 10 in the vicinity of an outer peripheral end LE on one side and a liquid supply chamber 9 in the vicinity of an outer peripheral end RE on the other side. Further, a first slit 14*a* is formed at a bottom portion of the liquid discharge chamber 10, and a second slit 14*b* is formed at a bottom portion of the liquid supply chamber 9. The cover plate 3 is adhered to the upper surface US of the actuator substrate 2 with an adhesive so as to partially cover the ejection groove 6*a* and the non-ejection groove 6*b* and expose the common terminal 16*a* and the active terminal 16*b*. The first slit 14*a* communicates with the end portion on the one side of the ejection groove 6*a*, and the second slit 14*b* communicates with the end portion on the other side of the ejection groove 6*a*. The non-ejection groove 6*b* does not communicate with the liquid supply chamber 9 and the liquid discharge chamber 10.

The nozzle plate 4 is adhered to the lower surface LS of the actuator substrate 2 with an adhesive. The nozzle 11 formed in the nozzle plate 4 communicates with the ejection groove 6*a*. The lower surface opening 8 of the non-ejection groove 6*b* is blocked by the nozzle plate 4.

A piezoelectric material, e.g., PZT ceramics, subjected to a polarization treatment in a direction perpendicular to the upper surface US can be used for the actuator substrate 2. The PZT ceramics, which is the same material as the actuator substrate 2, machinable ceramics or other ceramics, and a low dielectric material, such as glass, can be used for the cover plate 3. If the same material as the actuator substrate 2 is used for the cover plate 3, thermal expansions are equalized, and generation of warpage or deformation due to temperature changes can be prevented. A polyimide film, a polypropylene film, another synthetic resin film, a metal film, and the like can be used for the nozzle plate 4. Here, it is preferable that the thickness of the cover plate 3 be 0.3 mm to 1.0 mm and that the thickness of the nozzle plate 4 be 0.01 mm to 0.1 mm. When the cover plate 3 is thinner than 0.3 mm, the strength thereof is reduced. When the cover plate 3 is thicker than 1.0 mm, it takes time to manufacture the liquid supply chamber 9, the liquid discharge chamber 10, and the first and second slits 14*a*, 14*b*, and further, it becomes costly due to the increase in materials. When the nozzle plate 4 is thinner than 0.01 mm, the strength thereof is reduced. When the nozzle plate 4 is thicker than 0.1 mm, vibrations are transmitted to adjacent nozzles, thereby easily generating crosstalk.

It should be noted that a Young's modulus of PZT ceramics is 58.48 GPa and a Young's modulus of polyimide is 3.4 GPa. Accordingly, if the PZT ceramics is used for the cover plate 3 and the polyimide film is used for the nozzle plate 4, stiffness of the cover plate 3 covering the upper surface US of the actuator substrate 2 is higher than that of the nozzle plate 4 covering the lower surface LS thereof. It is preferable that the Young's modulus of the material of the cover plate 3 be not less than 40 GPa and that the Young's modulus of the material of the nozzle plate 4 be within the range of 1.5 GPa to 30 GPa. If the Young's modulus of the nozzle plate 4 is less than 1.5 GPa, the nozzle plate 4 is easily scratched at the time of contacting a recording medium, thereby decreasing reliability. If the Young's modulus of the nozzle plate 4 exceeds 30 GPa, vibrations are transmitted to adjacent nozzles, thereby easily generating crosstalk.

This liquid jet head 1 is driven as follows. Liquid supplied from the liquid supply chamber 9 flows into the ejection groove 6*a* via the second slit 14*b*, and further flows from the ejection groove 6*a* to the liquid discharge chamber 10 via the first slit 14*a*. Then, when a drive signal is applied to the common terminal 16*a* and the active terminal 16*b*, both walls sandwiching the ejection groove 6*a* are deformed in a thickness-shear mode, generating a pressure wave in the liquid filling the ejection groove 6*a*. Droplets are ejected from the nozzle 11 by this pressure wave, and the liquid is recorded on a recording medium. By separating the common electrode 12*a* and the active electrode 12*b* from the bottom surface of the groove 6, i.e., the nozzle plate 4, the liquid-induced pressure wave is stabilized and the droplets can be stably ejected. It should be noted that regarding the above-described drive signal, more specifically, a GND potential is applied to the common electrode 12*a* via the common terminal 16*a*, and a drive voltage is applied to the active electrode 12*b* via the active terminal 16*b*.

It should be noted that in the present embodiment, regarding the lower surface opening 8 of the ejection groove 6*a* and the lower surface opening 8 of the non-ejection groove 6*b* which open on the lower surface LS of the actuator substrate 2, in the array direction of the grooves 6, the end portions on one side of the lower surface openings 8 of the ejection groove 6*a* and the non-ejection groove 6*b* align, and the end portion on the other side of the lower surface opening 8 of the non-ejection groove 6*b* is longer than that of the lower surface opening 8 of the ejection groove 6*a*. Accordingly, the ejection groove 6*a* and the non-ejection groove 6*b* can be distinguished. Alternatively, in the array direction of the grooves 6, the end portions on the other side of the lower surface openings 8 of the ejection groove 6*a* and the non-ejection groove 6*b* may align, and the end portion on the one side of the lower surface opening 8 of the non-ejection groove 6*b* may be longer than that of the lower surface opening 8 of the ejection groove 6*a*. Accordingly, the ejection groove 6*a* and the non-ejection groove 6*b* can be distinguished. Moreover, the both end portions of the lower surface opening 8 of the non-ejection groove 6*b* may be made longer than the both end portions of the lower surface opening 8 of the ejection groove 6*a*. Further, the functions of the liquid discharge chamber 10 and the liquid supply chamber 9 may be reversed, and the liquid may be supplied from the liquid discharge chamber 10 and discharged from the liquid supply chamber 9.

(Second Embodiment)

Figure 2:
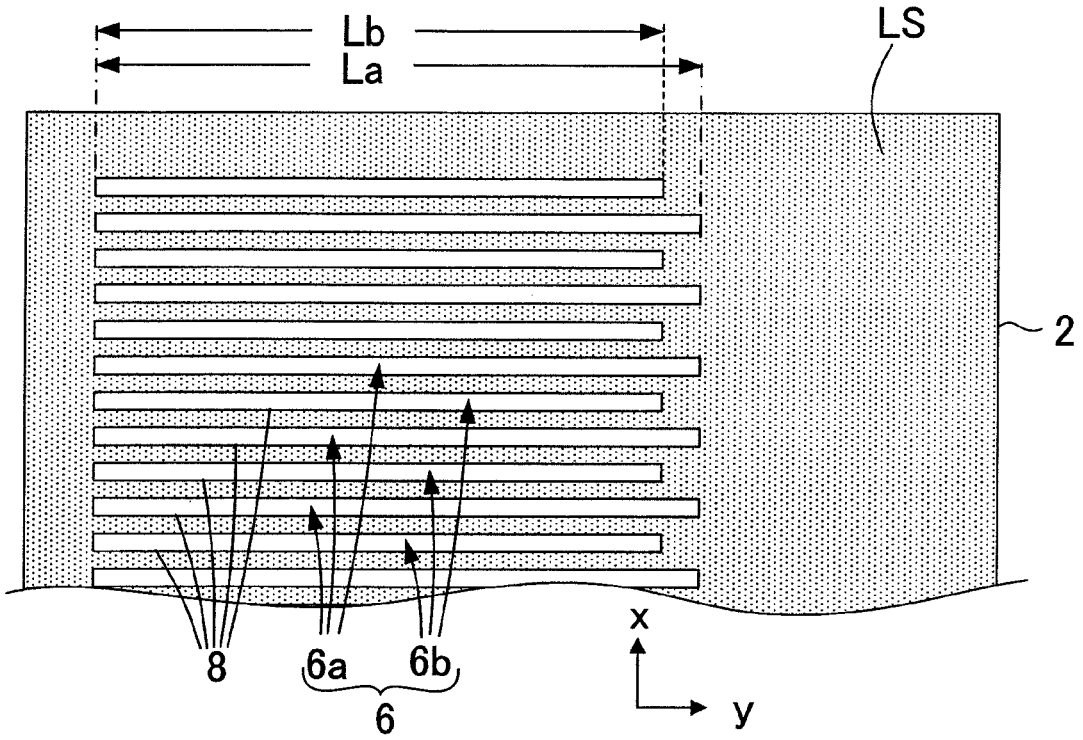
FIG. 2 is a schematic plan view of an actuator substrate of a liquid jet head, as viewed from a side opposite to a cover plate, according to a second embodiment of the present invention.

FIG. 2 is a schematic plan view of an actuator substrate 2 of a liquid jet head 1, as viewed from a side opposite to a cover plate 3, according to a second embodiment of the present invention. The second embodiment is different from the first embodiment in that a longitudinal length Lb of a lower surface opening 8 of a non-ejection groove 6*b* is shorter than a longitudinal length La of a lower surface opening 8 of an ejection groove 6*a*. The other structures are similar to those of the first embodiment. The same portions and the portions having the same function are denoted by the same reference numerals.

As illustrated in FIG. 2, the longitudinal length Lb of the lower surface opening 8 of the non-ejection groove 6*b* is shorter than the longitudinal length La of the lower surface opening 8 of the ejection groove 6*a*. More specifically, in an array direction (x direction) of grooves 6, end portions on one side of the lower surface openings 8 of the ejection groove 6*a* and the non-ejection groove 6*b* align, and an end portion on another side of the lower surface opening 8 of the non-ejection groove 6*b* is shorter than that of the lower surface opening 8 of the ejection groove 6*a* toward the one side (−y direction side). With this configuration, the ejection groove 6*a* and the non-ejection groove 6*b* can be easily distinguished, as viewed from a lower surface LS side of the actuator substrate 2.

The longitudinal length of the lower surface opening 8 of the non-ejection groove 6*b* is made shorter than the longitudinal length of the lower surface opening 8 of the ejection groove 6*a*. Similarly to the description in the first embodiment, when the actuator substrate 2 is ground with a dicing blade, the non-ejection groove 6*b* may be ground shallower than the ejection groove 6*a*, or the non-ejection groove 6*b* may be ground shorter than the ejection groove 6*a* in the longitudinal direction. By using a light transmitting nozzle plate 4, a nozzle 11 can be easily aligned with the ejection groove 6*a*. Alternatively, the nozzle 11 can be easily formed in the light transmitting nozzle plate 4, with the lower surface opening 8 checked.

Since the other structures are similar to those of the first embodiment, description thereof is omitted. It should be noted that in the present embodiment, regarding the lower surface opening 8 of the ejection groove 6*a* and the lower surface opening 8 of the non-ejection groove 6*b* which open on the lower surface LS of the actuator substrate 2, in the array direction of the grooves 6, the end portions on the one side of the lower surface openings 8 of the ejection groove 6*a* and the non-ejection groove 6*b* align, and the end portion on the other side of the lower surface opening 8 of the non-ejection groove 6*b* is shorter than that of the lower surface opening 8 of the ejection groove 6*a*. Accordingly, the ejection groove 6*a* and the non-ejection groove 6*b* can be distinguished. Alternatively, in the array direction of the grooves 6, the end portions on the other side of the lower surface openings 8 of the ejection groove 6*a* and the non-ejection groove 6*b* may align, and the end portion on the one side of the lower surface opening 8 of the non-ejection groove 6*b* may be shorter than that of the lower surface opening 8 of the ejection groove 6*a*. Accordingly, the ejection groove 6*a* and the non-ejection groove 6*b* can be distinguished. Moreover, the both end portions of the lower surface opening 8 of the non-ejection groove 6*b* may be made shorter than the both end portions of the lower surface opening 8 of the ejection groove 6*a*.

(Third Embodiment)

Figure 3:
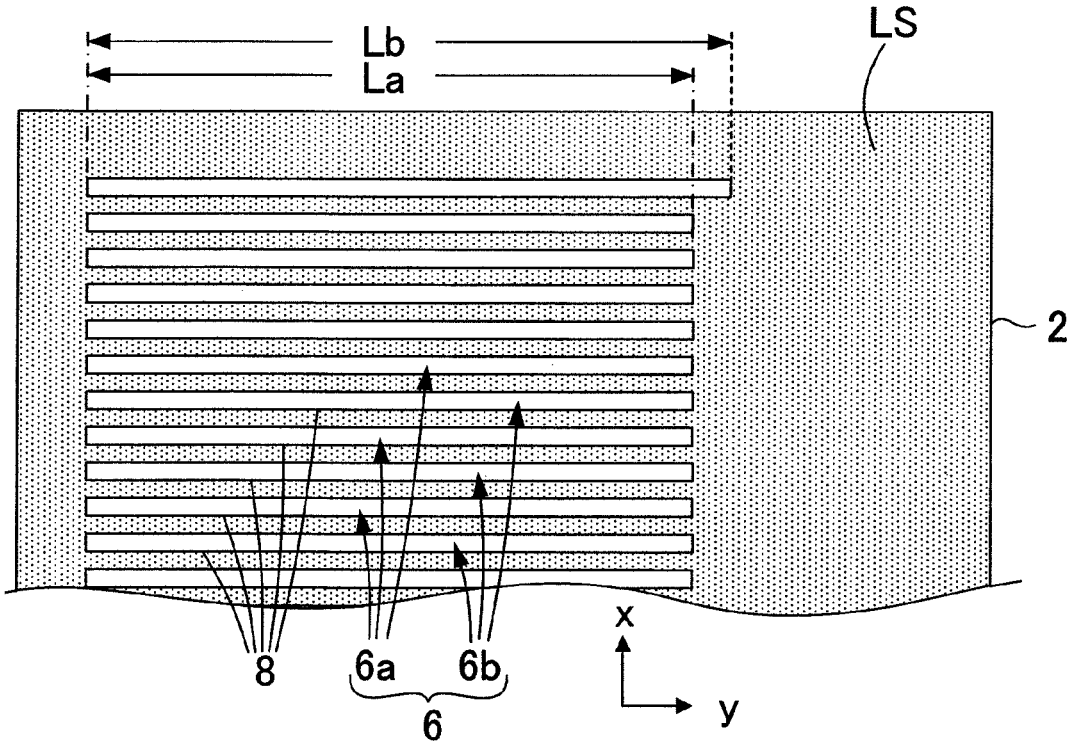
FIG. 3 is a schematic plan view of an actuator substrate of a liquid jet head, as viewed from a side opposite to a cover plate, according to a third embodiment of the present invention.

FIG. 3 is a schematic plan view of an actuator substrate 2 of a liquid jet head 1, as viewed from a side opposite to a cover plate 3, according to a third embodiment of the present invention. The third embodiment is different from the first embodiment in that a longitudinal length of a lower surface opening 8 of a groove 6 placed at the edge in an array direction of the grooves 6 is different from longitudinal lengths of lower surface openings 8 of the other grooves 6. The other structures are similar to those of the first embodiment. The same portions and the portions having the same function are denoted by the same reference numerals.

As illustrated in FIG. 3, in the array direction (x direction) in which the grooves 6 are arrayed, the longitudinal (y direction) length of the lower surface opening 8 of the groove 6 placed at least at one edge is different from the longitudinal lengths of the lower surface openings 8 of the grooves 6 placed at other positions. More specifically, an end portion in the longitudinal direction of the lower surface opening 8 of the groove 6 placed at the edge in the array direction (+x direction) is aligned with those of the lower surface openings 8 of the other grooves 6, and another end portion in the longitudinal direction of the lower surface opening 8 of the groove 6 is placed farther on the other side than those of the lower surface openings 8 of the other grooves 6. With this configuration, the groove 6 placed at the edge in the array direction is easily visible, as viewed from a lower surface LS side of the actuator substrate 2. Further, by previously setting the groove 6 placed at the edge in the array direction as an ejection groove 6*a* or *a* non-ejection groove 6*b*, the ejection groove 6*a* and the non-ejection groove 6*b* are easily visible. By so doing, a nozzle 11 can be easily aligned with the ejection groove 6*a* using a light transmitting nozzle plate 4. Alternatively, the nozzle 11 can be easily formed in the light transmitting nozzle plate 4, with the lower surface opening 8 checked.

Since the other structures are similar to those of the first embodiment, description thereof is omitted. It should be noted that in the present embodiment, the lower surface opening 8 of the groove 6 placed at least at one edge in the array direction of the grooves 6 and the lower surface openings 8 of the other grooves 6 are formed in such a manner that the end portions on one side in the longitudinal direction of the lower surface openings 8 of the grooves 6 align, and that the end portions on the other side in the longitudinal direction thereof do not align. Alternatively, relative to the array direction (x direction), the end portions on the other side (+y direction side) in the longitudinal direction (y direction) may align, and the end portions on one side (−y direction side) in the longitudinal direction may not align. Also, the end portions on neither side may align relative to the array direction. Since the other structures are similar to those of the first embodiment, description thereof is omitted.

(Fourth Embodiment)

Figure 4:
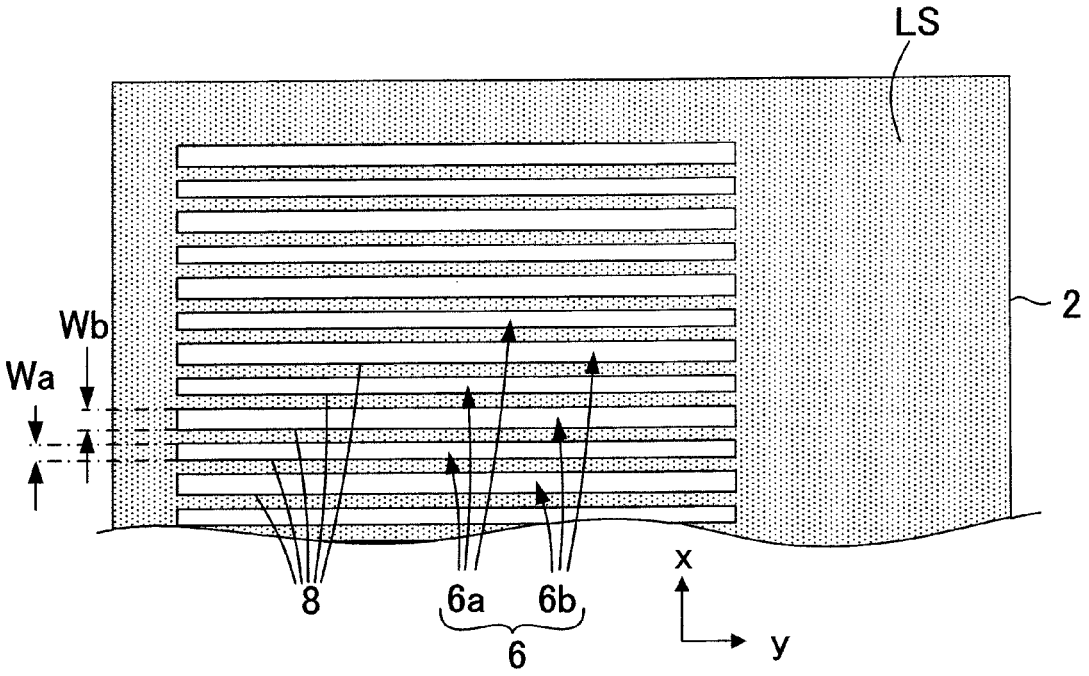
FIG. 4 is a schematic plan view of an actuator substrate of a liquid jet head, as viewed from a side opposite to a cover plate, according to a fourth embodiment of the present invention.

FIG. 4 is a schematic plan view of an actuator substrate 2 of a liquid jet head 1, as viewed from a side opposite to a cover plate 3, according to a fourth embodiment of the present invention. The fourth embodiment is different from the first embodiment in that the width in a short side direction (x direction) of a lower surface opening 8 of a non-ejection groove 6*b* is larger than that of a lower surface opening 8 of an ejection groove 6*a*. The other structures are similar to those of the first embodiment. The same portions and the portions having the same function are denoted by the same reference numerals.

As illustrated in FIG. 4, the width in the short side direction of the lower surface opening 8 of the non-ejection groove 6*b* is different from that of the lower surface opening 8 of the ejection groove 6*a*. More specifically, a width Wb in the short side direction of the lower surface opening 8 of the non-ejection groove 6*b* is larger than a width Wa in the short side direction of the lower surface opening 8 of the ejection groove 6*a*. The widths of the ejection groove 6*a* and the non-ejection groove 6*b* can be easily changed by grinding the actuator substrate 2 with the thickness of a dicing blade changed. Since the other structures are similar to those of the first embodiment, description thereof is omitted.

With this configuration, the ejection groove 6*a* and the non-ejection groove 6*b* are easily visible, as viewed from a lower surface LS side of the actuator substrate 2. As a result, a nozzle 11 can be easily aligned with the ejection groove 6*a* using a light transmitting nozzle plate 4. Alternatively, the nozzle 11 can be easily formed in the light transmitting nozzle plate 4, with the lower surface opening 8 checked. It should be noted that in the present embodiment, the width of the lower surface opening 8 of the non-ejection groove 6*b* is larger than that of the lower surface opening 8 of the ejection groove 6*a*. Alternatively, the width of the lower surface opening 8 of the non-ejection groove 6*b* may be made smaller than that of the lower surface opening 8 of the ejection groove 6*a*. Moreover, the width in the short side direction of the lower surface opening 8 of the groove 6 placed at least at one edge in the array direction may be made different from those of the lower surface openings 8 of the grooves 6 at the other positions.

(Fifth Embodiment)

Figure 5:
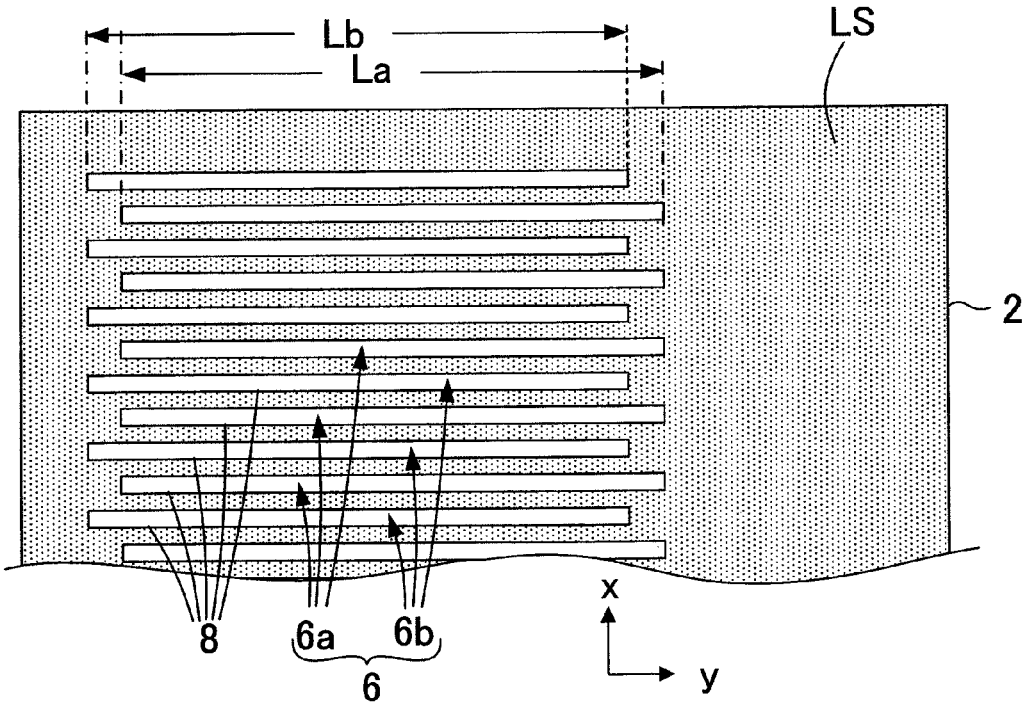
FIG. 5 is a schematic plan view of an actuator substrate of a liquid jet head, as viewed from a side opposite to a cover plate, according to a fifth embodiment of the present invention.

FIG. 5 is a schematic plan view of an actuator substrate 2 of a liquid jet head 1, as viewed from a side opposite to a cover plate 3, according to a fifth embodiment of the present invention. The fifth embodiment is different from the first embodiment in that a lower surface opening 8 of an ejection groove 6*a* is deviated from that of a non-ejection groove 6*b* in a longitudinal direction (y direction) of the lower surface openings 8. The other structures are similar to those of the first embodiment. The same portions and the portions having the same function are denoted by the same reference numerals.

As illustrated in FIG. 5, longitudinal lengths of the lower surface openings 8 of the ejection groove 6*a* and the non-ejection groove 6*b* are equal, and a position of the ejection groove 6*a* is deviated from that of the non-ejection groove 6*b* in the longitudinal direction (+y direction) of the lower surface openings 8. If the ejection groove 6*a* is deviated in a +y direction and the non-ejection groove 6*b* is deviated in a −y direction in advance, or vice versa, the ejection groove 6*a* and the non-ejection groove 6*b* are easily visible, as viewed from a lower surface LS side of the actuator substrate 2. As a result, a nozzle 11 can be easily aligned with the ejection groove 6*a* using a light transmitting nozzle plate 4. Alternatively, the nozzle 11 can be easily formed in the light transmitting nozzle plate 4, with the lower surface opening 8 visually checked.

(Sixth Embodiment)

Figure 6A:
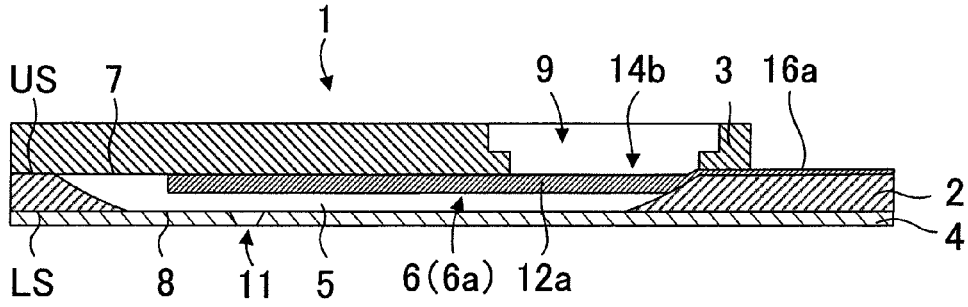
FIGS. 6A and 6B are schematic cross-sectional views of a liquid jet head according to a sixth embodiment of the present invention.
Figure 6B:
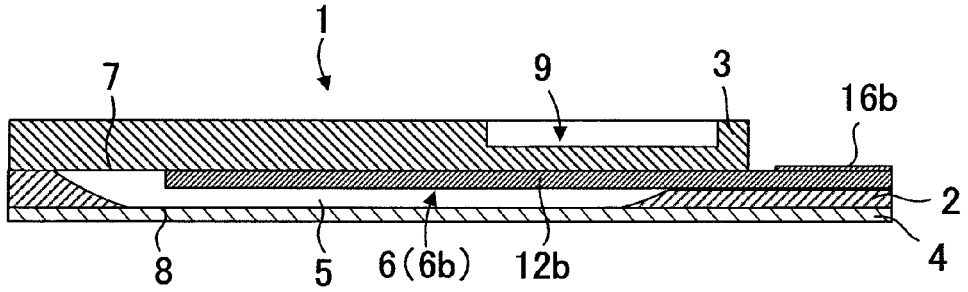

FIGS. 6A and 6B are schematic cross-sectional views of a liquid jet head 1 according to a sixth embodiment of the present invention. FIG. 6A is a schematic cross-sectional view of an ejection groove 6*a* in a longitudinal direction thereof, and FIG. 6B is a schematic cross-sectional view of a non-ejection groove 6*b* in a longitudinal direction thereof. The sixth embodiment is different from the first embodiment in that the liquid jet head 1 is an ejection type in which liquid does not circulate. The other structures are similar to those of the first embodiment. The same portions and the portions having the same function are denoted by the same reference numerals.

As illustrated in FIGS. 6A and 6B, the liquid jet head 1 includes an actuator substrate 2, a cover plate 3 provided on an upper surface US of the actuator substrate 2, and a nozzle plate 4 provided on a lower surface LS of the actuator substrate 2. The actuator substrate 2 is partitioned by an elongated wall 5 formed of a piezoelectric body. The ejection groove 6*a* and the non-ejection groove 6*b*, which penetrate from the upper surface US to the lower surface LS of the actuator substrate 2 and are long in the surface direction, are alternately arrayed in the actuator substrate 2. The cover plate 3 is provided at the actuator substrate 2 so as to cover an upper surface opening 7 of the ejection groove 6*a* or the non-ejection groove 6*b*, and has a liquid supply chamber 9 for supplying liquid to the ejection groove 6*a*. The nozzle plate 4 includes a nozzle 11 for communicating with the ejection groove 6*a*, and is provided at the actuator substrate 2 so as to cover a lower surface opening 8 of the ejection groove 6*a* or the non-ejection groove 6*b*. Further, on a side surface of the wall 5, a common electrode 12*a* and an active electrode 12*b* are provided with a depth of separating from the nozzle plate 4, and are strip-shaped in a longitudinal direction of the wall 5. Additionally, stiffness of the nozzle plate 4 is lower than that of the cover plate 3.

Configurations of the ejection groove 6*a* and the non-ejection groove 6*b* and structures thereof, such as positions formed at the actuator substrate 2, are similar to those of the first embodiment. Further, common electrodes 12*a* formed on both side surfaces of the ejection groove 6*a*, *a* common terminal 16*a* electrically connected to the common electrodes 12*a*, active electrodes 12*b* formed on both side surfaces of the non-ejection groove 6*b*, and an active terminal 16*b* electrically connected to the active electrodes 12*b* are similar to those of the first embodiment.

The cover plate 3 includes the liquid supply chamber 9 on another side of the actuator substrate 2. The liquid supply chamber 9 communicates with the ejection groove 6*a* via a second slit 14*b* and does not communicate with the non-ejection groove 6*b*. The cover plate 3 is adhered to the upper surface US of the actuator substrate 2 with an adhesive, and the nozzle plate 4 is adhered to the lower surface LS of the actuator substrate 2 with an adhesive. The nozzle plate 4 is provided with the nozzle 11 communicating with the ejection groove 6*a*. The nozzle 11 is placed closer to one side of the ejection groove 6*a* than a longitudinal center thereof. It should be noted that the nozzle 11 may be placed at the center of the ejection groove 6*a*. The ejection groove 6*a* is filled with liquid supplied to the liquid supply chamber 9 via the second slit 14*b*. Since driving of the liquid jet head 1 is similar to that of the first embodiment, description thereof is omitted.

Further, stiffness, Young's moduli, and thicknesses of the cover plate 3 and the nozzle plate 4 are similar to those of the first embodiment. As a result, even if the nozzle plate 4 contacts the recording medium, the nozzle plate 4 is hardly scratched and crosstalk can be prevented. Moreover, since the common electrode 12*a* and the active electrode 12*b* are formed separately from the nozzle plate 4, droplets are stably ejected from the nozzle 11.

The lower surface openings 8 of the ejection groove 6*a* and the non-ejection groove 6*b*, which open on the lower surface LS of the actuator substrate 2, are similar to those of the first embodiment. Accordingly, when the nozzle plate 4 is adhered to the lower surface LS of the actuator substrate 2, by using a light transmitting film as the nozzle plate 4, the nozzle 11 formed in the nozzle plate 4 can be easily aligned with the ejection groove 6*a* of the actuator substrate 2. Alternatively, after the nozzle plate 4 is adhered to the lower surface LS of the actuator substrate 2, the position of the nozzle 11 communicating with the ejection groove 6*a* can be easily determined. Further, it is apparent that the lower surface openings 8 of the ejection groove 6*a* and the non-ejection groove 6*b* in the above-described second to fourth embodiments can be applied to those of the present embodiment.

(Seventh Embodiment)

Figure 7:
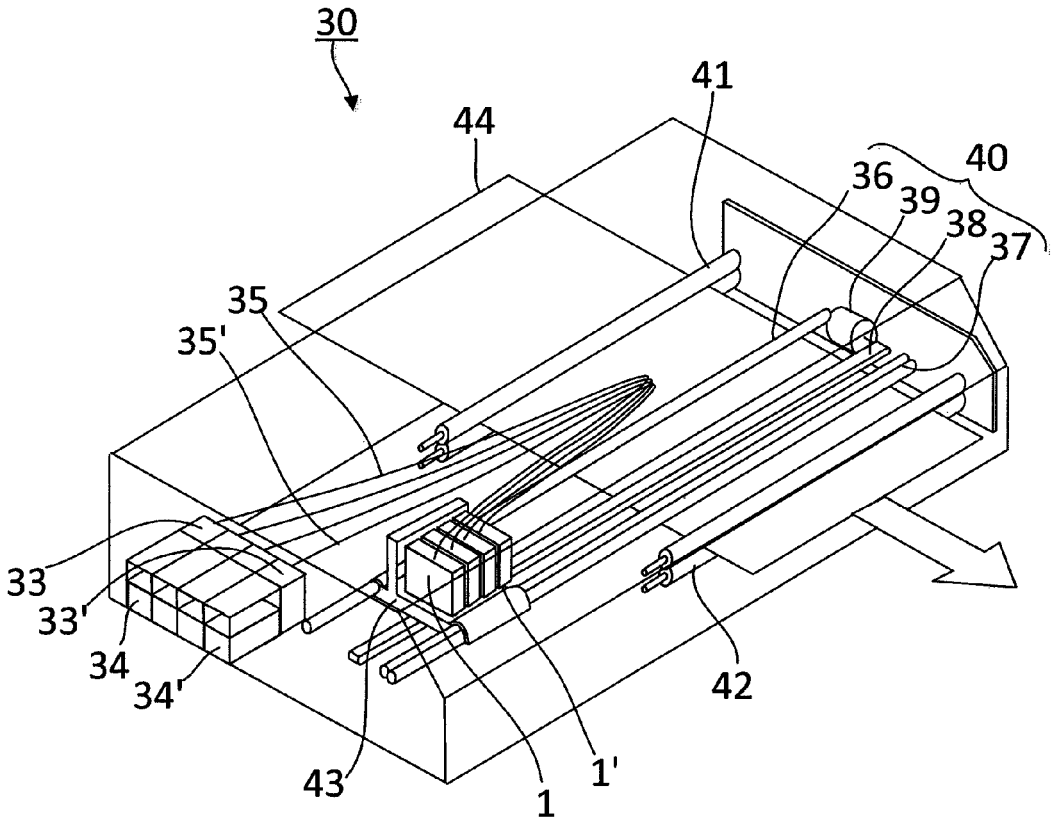
FIG. 7 is a schematic perspective view of a liquid jet apparatus according to a seventh embodiment of the present invention.
Figure 8A:
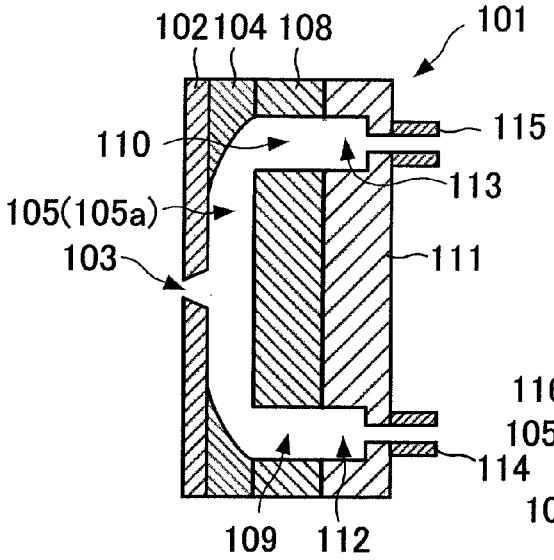
Fig.8A Prior art
FIGS. 8A and 8B are schematic cross-sectional views of a conventionally known liquid jet head.
Figure 8B:
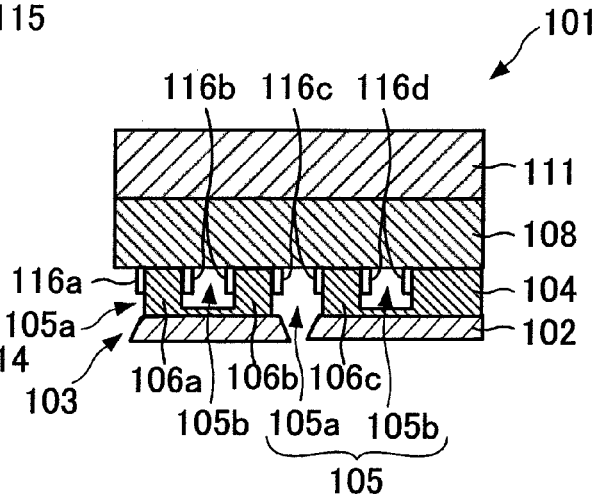
Fig.8B Prior art
Figure 9:
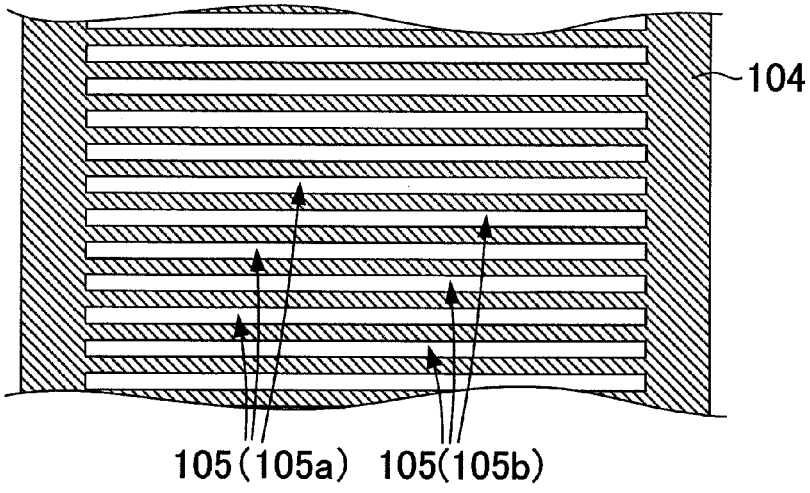
Fig.9 Prior art
FIG. 9 is a schematic plan view of a piezoelectric plate before a conventionally known nozzle plate is adhered thereto, as viewed from a side opposite to a cover plate.

FIG. 7 is a schematic perspective view of a liquid jet apparatus 30 according to a seventh embodiment of the present invention. The liquid jet apparatus 30 includes a moving mechanism 40 for reciprocating liquid jet heads 1, 1', flow path sections 35, 35' for supplying liquid to the liquid jet heads 1, 1' and discharging the liquid from the liquid jet heads 1, 1', and liquid pumps 33, 33' and liquid tanks 34, 34' communicating with the flow path sections 35, 35'. Each of the liquid jet heads 1, 1' includes a plurality of head chips, each head chip includes a plurality of channels, and droplets are ejected from a nozzle communicating with each channel. As the liquid pumps 33, 33', either supply pumps for supplying the liquid to the flow path sections 35, 35' or a discharge pump for discharging the liquid to other sections, or both, are provided. Further, a pressure sensor or a flow rate sensor (not illustrated) may be also provided so as to control a flow rate of the liquid. Any one of the first to fourth embodiments described above can be used for the liquid jet head 1, 1'.

The liquid jet apparatus 30 includes a pair of conveyance units 41, 42 for conveying a recording medium 44, such as paper, in a main scanning direction, the liquid jet heads 1, 1' for ejecting the liquid to the recording medium 44, a carriage unit 43 on which the liquid jet heads 1, 1' are mounted, the liquid pumps 33, 33' for pressing and supplying the liquid stored in the liquid tanks 34, 34' to the flow path sections 35, 35', and the moving mechanism 40 for scanning the liquid jet heads 1, 1' in a sub-scanning direction orthogonal to the main scanning direction. A control section (not illustrated) controls and drives the liquid jet heads 1, 1', the moving mechanism 40, and the conveyance units 41, 42.

The pair of conveyance units 41, 42 extends in the sub-scanning direction and each includes a grid roller and a pinch roller which rotate with roller surfaces thereof in contact with each other. The grid roller and the pinch roller are rotated around shafts by a motor (not illustrated) and the recording medium 44 held between the rollers is conveyed in the main scanning direction. The moving mechanism 40 includes a pair of guide rails 36, 37 which extends in the sub-scanning direction, the carriage unit 43 which is slidable along the pair of guide rails 36, 37, an endless belt 38 to which the carriage unit 43 is coupled and which moves the carriage unit 43 in the sub-scanning direction, and a motor 39 for circling this endless belt 38 via a pulley (not illustrated).

The plurality of liquid jet heads 1, 1' is mounted on the carriage unit 43, which ejects four kinds of droplets, e.g., yellow, magenta, cyan, and black. The liquid tanks 34, 34' store the liquids having corresponding colors and supply the liquids to the liquid jet heads 1, 1' via the liquid pumps 33, 33' and the flow path sections 35, 35'. Each of the liquid jet heads 1, 1' ejects droplets of each color according to a drive signal. By controlling a timing at which the liquid is ejected from the liquid jet heads 1, 1', rotation of the motor 39 driving the carriage unit 43, and a conveyance speed of the recording medium 44, any pattern can be recorded on the recording medium 44.

It should be noted that the present embodiment is the liquid jet apparatus 30 in which the moving mechanism 40 moves the carriage unit 43 and the recording medium 44 for recording. However, in place of this, it is possible to employ the liquid jet apparatus in which the carriage unit is fixed and the moving mechanism moves the recording medium two-dimensionally for recording. In other words, any moving mechanism can be employed as long as the liquid jet head and the recording medium are moved relatively.

What is claimed is:

1. A liquid jet head, comprising:

an actuator substrate having an array of grooves which penetrate from an upper surface to a lower surface of the substrate and which are longer in a substrate surface direction than in a depth direction, wherein the grooves include ejection grooves and non-ejection grooves which are alternately arrayed, the ejection grooves and the non-ejection grooves are different in configurations of the lower surface openings or in positions of the lower surface openings in a longitudinal direction of the grooves, and a longitudinal length of the lower surface openings of the non-ejection grooves is longer than a longitudinal length of the lower surface openings of the ejection grooves;

a nozzle plate provided at the actuator substrate to cover the lower surface openings of the grooves; and a cover plate provided at the actuator substrate to cover upper surface openings of the grooves, the cover plate having a liquid supply chamber communicating with the ejection grooves at one end portion thereof and a liquid discharge chamber communicating with the ejection grooves at the other end portion thereof to circulate liquid through the ejection grooves.

2. The liquid jet head according to claim 1, wherein an end portion on one side of the lower surface openings of the non-ejection grooves is aligned with an end portion on the one side of the lower surface openings of the ejection grooves in the longitudinal direction, and an end portion on another side of the lower surface openings of the non-ejection grooves is longer than an end portion on the other side of the lower surface openings of the ejection grooves in the longitudinal direction.

3. The liquid jet head according to claim 1, wherein in a direction in which the grooves are arrayed, the longitudinal length of the lower surface opening of the groove placed at least at one edge is different from the longitudinal lengths of the lower surface openings of the grooves at other positions.

4. The liquid jet head according to claim 1, wherein one of the non-ejection grooves is placed at an edge in the direction in which the grooves are arrayed.

5. The liquid jet head according to claim 1, wherein the nozzle plate includes a light transmitting film.

6. A liquid jet apparatus, comprising:

the liquid jet head according to claim 1;

a moving mechanism configured to relatively move the liquid jet head and a recording medium;

a liquid supply tube configured to supply liquid to the liquid jet head; and a liquid tank configured to supply the liquid to the liquid supply tube.

7. A liquid jet head, comprising:

an actuator substrate having an array of grooves which penetrate from an upper surface to a lower surface of the substrate and which are longer in a substrate surface direction than in a depth direction, wherein the grooves include ejection grooves and non-ejection grooves which are alternately arrayed, and the ejection grooves and the non-ejection grooves are different in configurations of the lower surface openings or in positions of the lower surface openings in a longitudinal direction of the grooves;

a nozzle plate provided at the actuator substrate to cover the lower surface openings of the grooves; and a cover plate provided at the actuator substrate to cover upper surface openings of the grooves, the cover plate having a liquid supply chamber communicating with the ejection grooves at one end portion thereof and a liquid discharge chamber communicating with the ejection grooves at the other end portion thereof to circulate liquid through the ejection grooves, wherein the longitudinal length of the lower surface openings of the non-ejection grooves is shorter than the longitudinal length of the lower surface openings of the ejection grooves; and wherein an end portion on one side of the lower surface openings of the non-ejection grooves is aligned with an end portion on the one side of the lower surface openings of the ejection grooves in the longitudinal direction, and an end portion on another side of the lower surface openings of the non-ejection grooves is shorter than an end portion on the other side of the lower surface openings of the ejection grooves in the longitudinal direction.

8. A liquid jet head, comprising:

an actuator substrate having an array of grooves which penetrate from an upper surface to a lower surface of the substrate and which are longer in a substrate surface direction than in a depth direction, wherein the grooves include ejection grooves and non-ejection grooves which are alternately arrayed, and the ejection grooves and the non-ejection grooves are different in configurations of the lower surface openings or in positions of the lower surface openings in a longitudinal direction of the grooves;

a nozzle plate provided at the actuator substrate to cover the lower surface openings of the grooves; and a cover plate provided at the actuator substrate to cover upper surface openings of the grooves, the cover plate having a liquid supply chamber communicating with the ejection grooves at one end portion thereof and a liquid discharge chamber communicating with the ejection grooves at the other end portion thereof to circulate liquid through the ejection grooves, wherein a width of the lower surface openings of the non-ejection grooves is different from a width of the lower surface openings of the ejection grooves in a short side direction, and wherein the width of the lower surface openings of the non-ejection grooves is larger than the width of the lower surface openings of the ejection grooves in the short side direction.

9. A liquid jet head, comprising:

an actuator substrate having opposed upper and lower surfaces, and longitudinally extending ejection grooves and non-ejection grooves penetrating in a depth direction through the actuator substrate from the upper surface to the lower surface and being alternately arrayed and separated from one another by walls made of piezoelectric material, the ejection and non-ejection grooes being longer in a substrate surface direction than in the depth direction;

a nozzle plate attached to the actuator sustrate and covering lower surface openings of the ejection and non-ejection grooves that open at the lower surface of the actuator substrate, the nozzle plate having nozzles that communicate with respective ejection grooves; and a cover plate attached to the actuator substrate and covering upper surface openings of the ejection and non-ejection grooves that open at the upper surface of the actuator plate, the cover plate having a liquid supply chamber communicating with one of the end portions of the ejection grooves and a liquid discharge chamber communicating with the other of the end portions of the ejection grooves to circulate liquid through the ejection grooves, wherein the lower surface openings of the ejection grooves have a different configuration or a different position in the longitudinal direction from that of the lower surface openings of the non-ejection grooves, and wherein the lower surface openings of the ejection grooves and the non-ejection grooves are aligned at one end in the longitudinal direction and not aligned at the other end in the longitudinal direction.

10. The liquid jet head according to claim 9; wherein the longitudinal length of the lower surface openings of the non-ejection grooves is different from the longitudinal length of the lower surface openings of the ejection grooves.

11. The liquid jet head according to claim 9, wherein a width of the lower surface openings of the non-ejection grooves is different from a width of the lower surface openings of the ejection grooves.

12. The liquid jet head according to claim 9; wherein the nozzle plate is transparent to light.

13. The liquid jet head according to claim 9, wherein the nozzle plate includes a light transmitting film.

* * * * *